US009718569B2

(12) United States Patent
Doll et al.

(10) Patent No.: US 9,718,569 B2
(45) Date of Patent: Aug. 1, 2017

(54) MODIFIED ATMOSPHERIC FLOW-WRAP SYSTEM

(75) Inventors: Paul E. Doll, Madison, WI (US); Timothy E. Coulson, Madison, WI (US); Eric J. Frederickson, Englewood, CO (US); Alexander D. Jones, Evanston, IL (US); Robert C. Jones, Aurora, IL (US)

(73) Assignee: Kraft Foods Group Brands LLC, Chicago, IL (US)

( * ) Notice: Subject to any disclaimer, the term of this patent is extended or adjusted under 35 U.S.C. 154(b) by 858 days.

(21) Appl. No.: 12/757,314

(22) Filed: Apr. 9, 2010

(65) Prior Publication Data

US 2010/0257820 A1 Oct. 14, 2010

Related U.S. Application Data

(60) Provisional application No. 61/168,883, filed on Apr. 13, 2009.

(51) Int. Cl.

| | |
|---|---|
| ***B65B 9/02*** | (2006.01) |
| ***B65B 31/04*** | (2006.01) |
| ***B65B 31/00*** | (2006.01) |
| ***B65B 9/06*** | (2012.01) |

(52) U.S. Cl.

CPC ..... *B65B 9/02* (2013.01); *B65B 9/06* (2013.01); *B65B 31/00* (2013.01); *B65B 31/04* (2013.01)

(58) Field of Classification Search

CPC B65B 9/02; B65B 31/04; B65B 31/00; B65B 9/06

USPC ..... 426/324, 395, 404, 418, 419; 53/428, 53/432, 433, 434, 440, 450, 511, 550

See application file for complete search history.

(56) References Cited

U.S. PATENT DOCUMENTS

| | | | | |
|---|---|---|---|---|
| 2,160,367 | A * | 5/1939 | Maxfield | 53/433 |
| 3,274,746 | A * | 9/1966 | James et al. | 53/433 |
| 3,636,678 | A | 1/1972 | Maros et al. | |

(Continued)

FOREIGN PATENT DOCUMENTS

| | | |
|---|---|---|
| EP | 0761541 | 3/1997 |
| GB | 1460107 | 12/1976 |

(Continued)

OTHER PUBLICATIONS

Definition of "align" and "along." Webster's New World Dictionary, Third College Edition. Simon & Schuster 1988.*

(Continued)

*Primary Examiner* — Viren Thakur

(74) *Attorney, Agent, or Firm* — Fitch, Even, Tabin & Flannery LLP

(57) ABSTRACT

A modified atmosphere flow-wrap system and method and components thereof are provided for packaging a food product in a reduced oxygen atmosphere in a continuous or partially-continuous process. In one aspect, the flow-wrap system includes a saturation tunnel for saturating the food products with modified gas to reduce an amount of residual oxygen therein. In another aspect, the flow-wrap system includes a flow-wrapping station with a modified gas lance that extends into film webbing used to form the food product packages to insert modified gas into the film webbing and restrict oxygen from entering the food packages.

18 Claims, 8 Drawing Sheets

(56) References Cited

U.S. PATENT DOCUMENTS

| | | | | | |
|---|---|---|---|---|---|
| 3,789,888 | A | * | 2/1974 | James et al. | 141/4 |
| 4,035,983 | A | * | 7/1977 | Shanklin et al. | 53/450 |
| 4,663,915 | A | * | 5/1987 | Van Erden et al. | 53/450 |
| 5,001,884 | A | * | 3/1991 | Hanagata | 53/58 |
| 5,109,654 | A | * | 5/1992 | Suga | 53/511 |
| 5,282,349 | A | | 2/1994 | Siegel | |
| 5,311,726 | A | * | 5/1994 | Rauscher et al. | 53/511 |
| 5,682,723 | A | * | 11/1997 | Nowotarski et al. | 53/403 |
| 5,941,052 | A | * | 8/1999 | Evangelisti | 53/433 |
| 5,956,931 | A | * | 9/1999 | Stork | 53/550 |
| 6,119,435 | A | * | 9/2000 | Fujiwara et al. | 53/389.3 |
| 6,123,969 | A | * | 9/2000 | Sjoberg | 426/410 |
| 6,735,928 | B2 | * | 5/2004 | Kondo et al. | 53/508 |
| 6,962,033 | B2 | * | 11/2005 | Guzman | 53/55 |
| 7,076,936 | B2 | * | 7/2006 | Limousin | 53/568 |
| 7,143,569 | B2 | * | 12/2006 | Limousin | 53/550 |
| 2005/0208188 | A1 | * | 9/2005 | Garwood | 426/392 |

FOREIGN PATENT DOCUMENTS

| | | |
|---|---|---|
| GB | 2236735 | 4/1991 |
| GB | 2250499 | 6/1992 |

OTHER PUBLICATIONS

European Search Report Patent Application No. 10250764.7 2308, dated Jul. 30, 2010.

* cited by examiner

MODIFIED ATMOSPHERIC FLOW-WRAP SYSTEM

CROSS-REFERENCE TO RELATED APPLICATION

This application claims benefit from U.S. Appl. Ser. No. 61/168,883, filed Apr. 13, 2009, which is hereby incorporated by reference in its entirety.

FIELD

This disclosure relates generally to food packaging systems, and more specifically to processes for packaging food products into reduced oxygen product packages.

BACKGROUND

Many food products are packaged in modified atmosphere packaging, which generally includes a package in which the internal atmosphere of the product package comprises a modified gas in place of ambient air. Specifically, modified atmosphere packaging attempts to replace the oxygen-containing ambient air that would ordinarily be present in a food package, with another type of gas, for example carbon dioxide or nitrogen. An objective of packaging food products in reduced-oxygen packaging is to increase the shelf-life of the food products.

Known attempts for forming, filling and sealing modified atmosphere packages include processes in which the ambient air and much of the residual oxygen within the food product are extracted using a vacuum or similar technology or dispersed by saturation with a modified gas. A package can then be formed around the food product and a modified gas can be injected into the package prior to sealing to provide a food package with a modified internal atmosphere. Optionally, a vacuum may be applied to the sealed food package to remove the headspace therefrom. In known attempts, these processes are often performed in discrete, intermittent steps in a package forming apparatus into which the products are individually indexed and where the above steps are carried out in sequence with pauses between each step as the food products advance to the next step.

Specifically, in one such attempt, a bottom forming film is heated in a thermoforming machine to form a bottom pocket with sidewalls within a die. Vent holes are then formed on each side of the bottom pocket. A pin is inserted through the vent holes and disperses a modified atmosphere gas into the bottom pocket. A food product is indexed and deposited into the bottom pocket. The partially packaged food product is advanced into a vacuum chamber. A top film is aligned with and overlain upon the bottom pocket. Seals between the top film and the bottom pocket are formed by applying heat to locations of contact between the bottom pocket and the top film. This and other known approaches are intermittent and, thus, expend time required to advance from one step to the next. Moreover, this particular approach uses a relatively thick and expensive bottom sheet for thermoforming the lower pocket, such as compared to the top film. Additionally, if the size of the food product is changed, the die used for forming the bottom pocket often must be changed and sized to fit the new food product. This can require additional expense and downtime of the packaging equipment if the size of the food product being packaged is changed.

SUMMARY

Modified atmosphere flow-wrapping systems are described herein, along with methods for substantially continuously flow-wrapping food packages with a modified internal atmosphere to reduce oxygen within the package.

Food products for packaging are advanced through a conditioning or saturation tunnel. In the saturation tunnel, the food products are saturated with a modified atmosphere gas in order to replace some of the residual oxygen within the food products, thereby reducing oxygen concentration within the food products which may otherwise escape when in the sealed package.

A flow wrapping station can be disposed downstream of the saturation tunnel. Preferably, there is minimal spacing between the flow wrapping station and the exit of the saturation tunnel so as to reduce the entry of oxygen into what will become the food package. Further, modified atmosphere gas may be discharged between the flow wrapping station and the exit of the saturation tunnel in order to reduce oxygen within what will become the food package.

The flow wrapping station includes a folding mechanism for folding a supply of a web of packaging film upon itself, such that there is an open edge portion and a fold at an opposite edge. The food product preferably exits the saturation tunnel into the folded web of packaging film. A gas emitter may be configured to dispense a modified atmosphere gas at the transition point between the saturation tunnel and the entry of the folded web of packaging film to saturate the product and the surface of the web of film that will eventually form the inner surface of the package with modified gas and to restrict oxygen from entering the food product from the surrounding atmosphere.

After the food product is placed within the folded web of packaging film, that portion of the film has the open edge portion sealed. A MAP gas or conditioning lance may be disposed in the folded web of packaging film, and may extend downstream and parallel to the machine direction. The conditioning lance may include a modified gas lance for dispensing a modified gas into the folded web or a vacuum lance for drawing gas from the folded web. In addition, both a modified gas lance and a vacuum lance may be used in combination or may be combined into a single lance. After the open edge portion is sealed, one or more cross seals may be made at predetermined intervals to form individual packages enclosing the food products and then the individual packages singulated from the remainder of the web of film.

Exemplary methods for substantially continuously flow-wrapping food packages with a reduced oxygen concentration include advancing food products through a saturation tunnel to reduce the concentration of residual oxygen. A web of film is folded over itself to form a partial enclosure with an open longitudinal side, which is subsequently sealed. Food products are deposited into the partial enclosure. A modified gas may be injected into the partial enclosure to restrict ambient air from entering the partial enclosure and increasing the concentration of oxygen therein. The partial enclosure is laterally sealed at predetermined intervals and singulated to form reduced oxygen food packages.

The use of the saturation tunnel for decreasing oxygen within the food product, the flow wrapping station downstream of the saturation tunnel for forming a package around the food product and the conditioning lance can combine to create a food packaging system for packaging food products at higher speeds, with reduced oxygen, with less expensive film and with greater flexibility for packaging food products of different sizes on a continuous or semi-continuous basis.

In one approach, a method of forming a reduced oxygen food package includes conditioning the food product to reduce an amount of residual oxygen within the food product. The method may also includes forming a partial enclosure from a web of film around the food product. In addition, the method may includes sealing one side of the partial enclosure to form a tubular precursor around the food product. The method also includes injecting a modified atmosphere gas into one of the partial enclosure and the tubular precursor while advancing the food product therein. The method according to this approach also includes sealing the tubular precursor to create a substantially hermetic food package surrounding the food product.

In another aspect, an apparatus for forming a reduced oxygen food package includes a conveyor system for advancing a food product. The apparatus also includes a conditioning tunnel for reducing a residual oxygen level of the food product as the food product is advanced therethrough. The apparatus according to this aspect also includes a flow-wrap station for forming a partial enclosure about the food product from a film webbing, while the food product is advanced to within the partial enclosure, and for sealing the partial enclosure to create a food package around the food product. The apparatus also includes a transition portion for transferring the food product from the conditioning tunnel to the flow-wrap station. A conditioning lance with a portion thereof extends into at least one of the partial enclosure and a partially sealed tubular precursor for reducing the concentration of oxygen within the food package.

In yet another aspect, method of packaging a series of oxygen-containing food products according to another aspect includes advancing said oxygen-containing food products on a conveyor through a tunnel having an entrance and an exit end on a continuing basis such that each of said food products is positioned within said tunnel for a predetermined period of time. The method also includes introducing a first gas that is essentially free from oxygen into said tunnel so as to displace air from said tunnel and maintain oxygen in said tunnel at a minimal level on a continuing basis, thereby reducing the oxygen content of said food products to residual levels, and providing egress of said gas from at least said exit end. The method according to this aspect also includes partially enclosing said food products in film wrap on a continuing basis as they emerge from the exit of said tunnel so as to form a tubular precursor comprising an open-ended tube having an opening proximal to the exit end of said tunnel. The method also includes introducing a second gas that is essentially free from oxygen into a region adjacent said film wrap upstream of said open-ended tubular precursor and introducing a third gas that is essentially free from oxygen into said open-ended tubular precursor. The method may also include partially enclosing a region between said exit end and said precursor and providing a vent path for egress of residual oxygen and other gases from said partially enclosed region. The method according to this aspect may also includes transversely sealing and dividing said precursor at predetermined intervals on a continuing basis to form a series of discrete hermetically sealed packaged food products having a reduced oxygen content.

DETAILED DESCRIPTION

Figure 1:
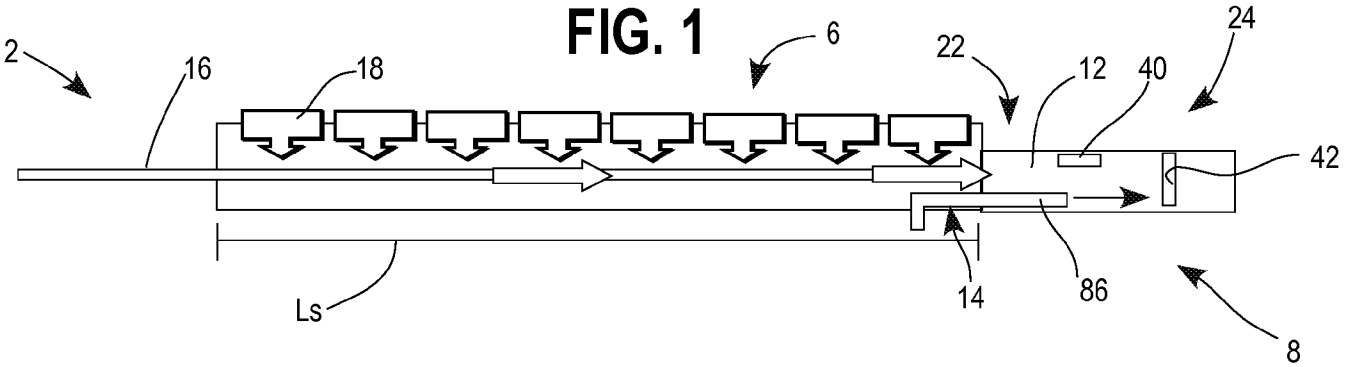
FIG. 1 is a side diagrammatic view of a modified atmosphere flow-wrap system, including a saturation tunnel for saturating a food product with a modified atmosphere gas and a flow wrap station, configured for forming a food package with a modified internal atmosphere.

A modified atmosphere flow-wrap system and method and components thereof are disclosed herein and illustrated in FIGS. 1-13. The modified atmosphere flow-wrap system is advantageously configured to create packaging for food products with a modified internal atmosphere in a continuous or partially-continuous process. In addition the modified atmosphere flow-wrap system can restrict oxygen from reentering the food product or package and further reduce the concentration of oxygen within the food product and package during the steps of wrapping the food product and sealing the food package. Finally, the modified atmosphere flow-wrap system may be configured to reduce the overall volume of gas within the food package in addition to creating a modified atmosphere therein. The system can be adapted to run generally continuously, without requiring stopping of the food product at multiple stations as it advances in the machine direction. This can result in faster operation of the packaging system. Further, the use of a thermoformed bottom film can be eliminated, thereby saving in the cost of film and facilitating use of the machine with different sizes of food products without requiring replacement or substitution of forming dies.

A modified atmosphere flow-wrap system 2 is generally provided for forming sealed food packages 10 with a modified internal atmosphere. A food product 4 is advanced through a conditioning tunnel where an amount of residual oxygen within the food product 4 is reduced as the food product 4 is advanced therethrough. In one approach, the conditioning tunnel includes a modified gas saturation tunnel 6 filled with a modified atmosphere gas for saturating the food product 4 and dispersing and/or replacing a portion of the oxygen therefrom to dilute the concentration of oxygen. The food product 4 is then advanced to a flow-wrap station 8 where a food package 10 is formed and sealed about the food product 4 from a film webbing 12. A conditioning lance 14 extends into the flow-wrap station 4 and reduces an amount of oxygen reentering the food product 4 due to ambient air entering the flow-wrap station 8, further lowers the concentration of oxygen in the food product 8, and can provide a modified atmosphere gas within the food package 10 upon sealing thereof.

Figure 2:
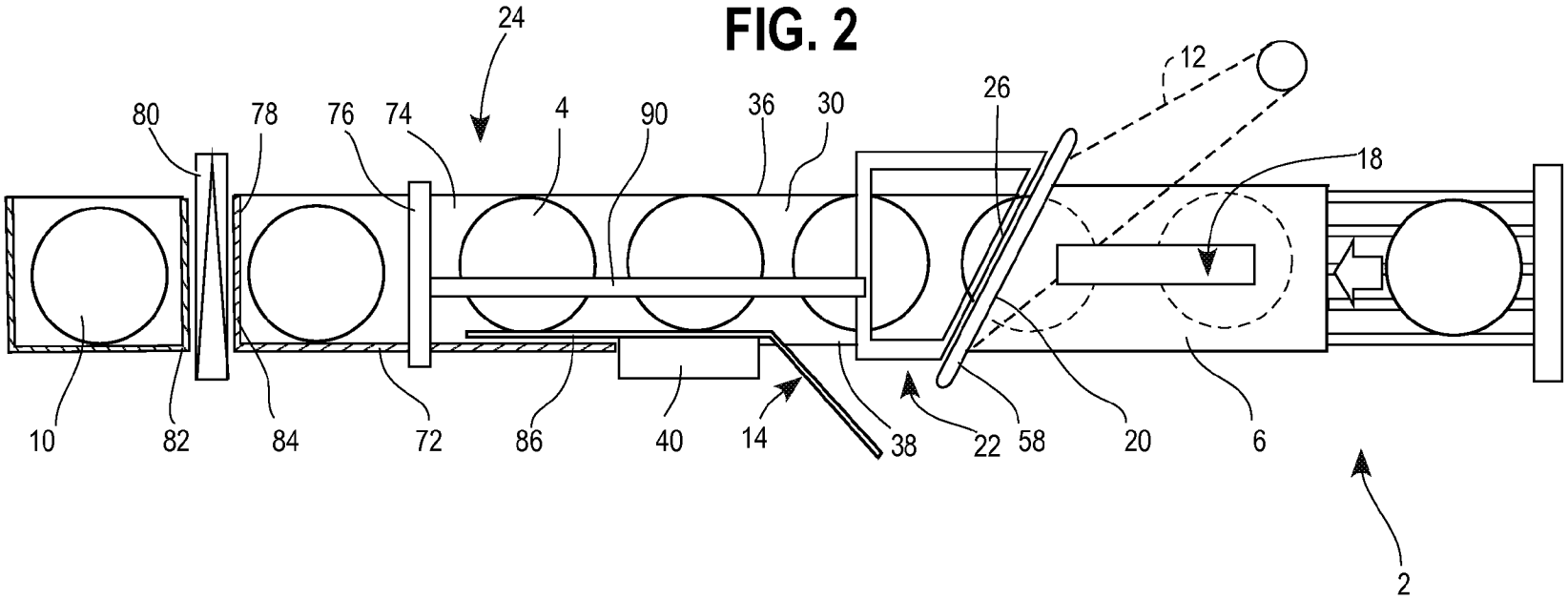
FIG. 2 is a top plan diagrammatic view of the modified atmosphere flow-wrap system of FIG. 1, illustrating a single line of dough-based products passing through the saturation tunnel and the flow wrapping station including a longitudinal sealer and a cross sealer/cutter used to seal and separate a film webbing into individual food packages.
Figure 8:
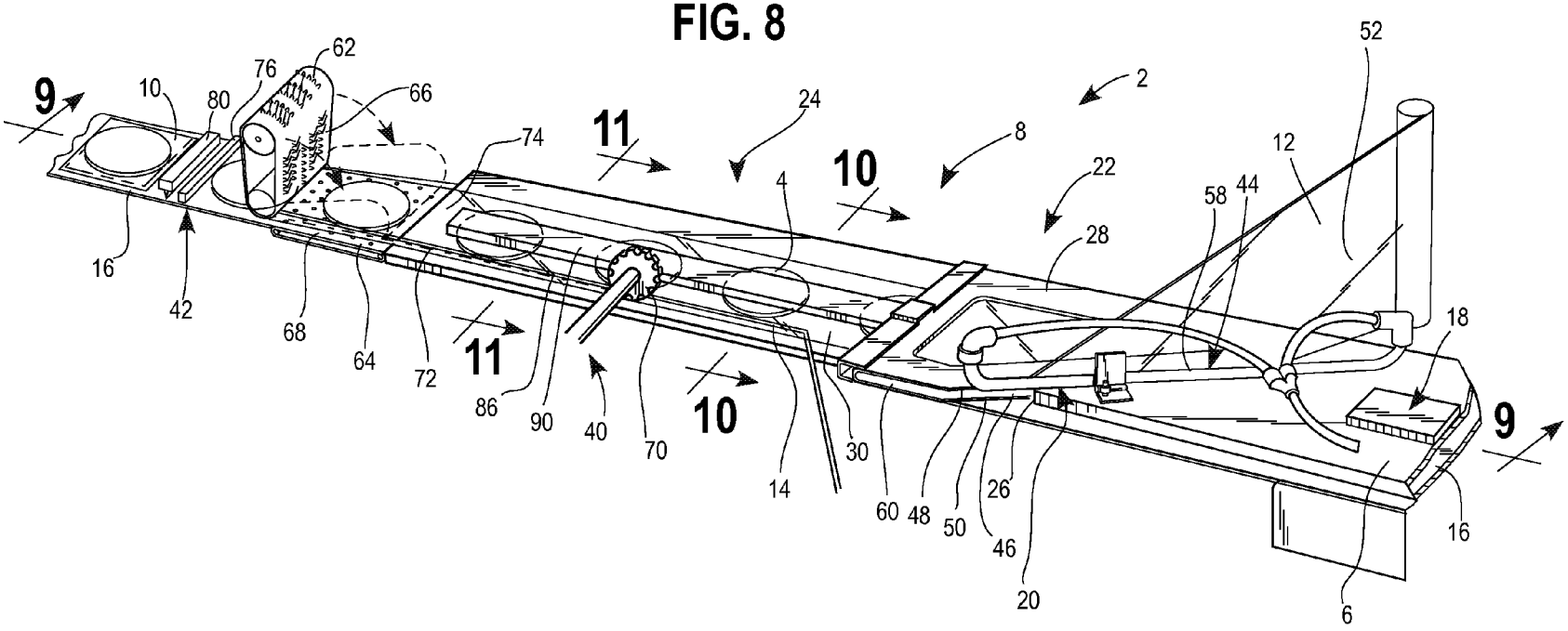
FIG. 8 is a representative perspective view of the modified atmosphere flow-wrap system in accordance with FIG. 1, illustrating a single line of dough-based products passing through the saturation tunnel and the flow wrapping station including a longitudinal sealer and a cross sealer/cutter used to seal and separate a film webbing into individual food packages.

Referring to FIGS. 1, 2, and 8, the modified atmosphere flow-wrap system 2 includes a saturation tunnel 6, a flow-wrap station 8, and a conveyor system 16 comprising one or more conveyors extending through at least a portion of the flow-wrap system 2, and, particularly, within the saturation tunnel 6. Food products 4 entering the modified atmosphere flow-wrap system 2 generally contain residual oxygen from exposure to ambient air during, for example, food preparation or travel of the food product to the modified atmosphere flow-wrap system 2. In this example, the food product 4 may be in the form of a flat-bread or pizza product, and may contain residual oxygen on the surface of the food product 4, within the dough, and within other ingredients that may be located on the food product 4, although the flow-wrap system 2 may be used for a variety of other food products for which flow-wrapping in a modified atmosphere is desired. The conveyor system 16 advances the food product 4 through the saturation tunnel 6, where the amount and concentration of residual oxygen in the food product 4 are reduced.

In one approach, the saturation tunnel 6 is configured for saturating the food product 4 with a modified gas in order to replace and/or displace at least a portion of the residual oxygen from the food product 4. Saturation of the food product 4 with a modified atmosphere gas also soaks the food product 4 with the modified gas, thereby diluting the concentration of oxygen as a portion of the overall gas content inherent within the food product 4. In this approach, modified gas is introduced into the saturation tunnel 6 via one or more modified gas nozzles 18. The modified gas utilized in the saturation tunnel may comprise any modified gas known in the art that is used for modified atmosphere packaging, including, but not limited to carbon dioxide and nitrogen or any other modified atmosphere gas or combination of gases. The modified gas is generally continuously introduced into the saturation tunnel to reduce oxygen to an acceptably low level.

Turning to more of the details, in one approach, the saturation tunnel 6 is a low profile tunnel formed around the conveyor system 16 to allow the food product 4 to pass therethrough. The low profile of the saturation tunnel 6 in this example provides a relatively small volume that must be filled with modified gas. In this approach, the atmosphere within the saturation tunnel 6 should include as close to 0% oxygen as possible, although the residual oxygen within the food products 4 themselves makes it difficult to actually attain 0% oxygen within the saturation tunnel 6.

In the saturation tunnel 6, at least a portion of the residual oxygen is purged from the food product 4 due to displacement by the modified gas, and the overall concentration of oxygen in the food product 4 is thereby reduced or diluted. In one approach, the pressure of the modified gas within the saturation tunnel 6 may be elevated in relation to the pressure of the residual oxygen in the food product 4 and/or the ambient air to more effectively cause saturation of the food product 4 with the modified gas and displacement of the residual oxygen therefrom. In one example, the nozzles 18 are covered with screens to disperse the modified gas as it exits the nozzles 18 to create laminar flow of the gas within the saturation tunnel to soak the food products 4 in modified gas. In another example, the nozzles 18 may include small openings directed at the passing food products that accelerate the modified gas and direct the gas toward the advancing food products 4 as it exits the nozzles 18, creating turbulent gas flow within the saturation tunnel 6. The pressure of the modified atmosphere within the saturation tunnel 6, the length $L_S$ of the saturation tunnel 6 and the speed of advancement of the food product 4 along the conveyor system 16 and through the saturation tunnel 6 can be optimized, for example based on empirical data, to provide a predetermined level or range of residual oxygen removal and dilution at the time the food product 4 exits the saturation tunnel 6, with the speed and the pressure, the amount and types of gas, adjusted to achieve the desired objectives.

In one approach, the speed of the conveyed food products 1, and the length of the saturation tunnel 6 are configured such that the food product 4 travels through the saturation tunnel 6 for between about 12-15 seconds before exiting at the saturation tunnel exit 20 in order to attain the desired level of residual oxygen remaining in the food product 4 upon exiting the saturation tunnel 6. In another approach, the food product 4 travels through the saturation tunnel 6 for about 12 seconds before exiting at the saturation tunnel exit 20. In one example, the length of the saturation tunnel is about 20 feet. In another example, when a relatively low residual oxygen containing food product, such as flatbread, is being packaged, the length of the saturation tunnel 6 is about 16 feet and the food product 4 travels through the saturation tunnel for about 20 seconds before exiting to reduce a measured level of oxygen in the package 50 to below about 0.5%. However, the amount of time that a food product 4 is subjected to the modified atmosphere in the saturation tunnel 6 may also vary with the type of food product being packaged. For example, food products that are thicker or contain more residual oxygen than flatbread may require a longer period of time in the saturation tunnel 6 to sufficiently reduce the amount of residual oxygen in the food product 4 to a desired level upon exit from the saturation tunnel exit 20. It will be appreciated that, in general, the longer the food product 4 is within the saturation tunnel, the lower the oxygen concentration will be.

In one approach, the food product 4, having a reduced level of residual oxygen, upon exiting the saturation tunnel 6, is transferred to the flow-wrap station 8. The flow-wrap station 8 is suitable for forming, filling and sealing a package, such as, flexible food package 10. In one approach, the flow-wrap station 8 includes a forming station 22 and a sealing station 24. At the forming station 22, film webbing 12 enters through a gap 26 and is folded over itself using a forming member 28 to form a partial enclosure 30 having a top panel 32 and a bottom panel 34 connected via a longitudinal fold forming a lateral side portion 36 and with a partial opening 38 opposite the fold 36. More specifically, the film webbing 12 is unwound from a roll of film. Advancing food products 4 are deposited in the partial enclosure 30 on the bottom panel 34 and with the top panel 32 overlying the food product 4. In this approach, the sealing station 24 includes longitudinal and lateral sealing stations 40 and 42 for forming longitudinal and lateral seals respectively about the partial enclosure to form a hermetically sealed food package 10.

Figure 5:
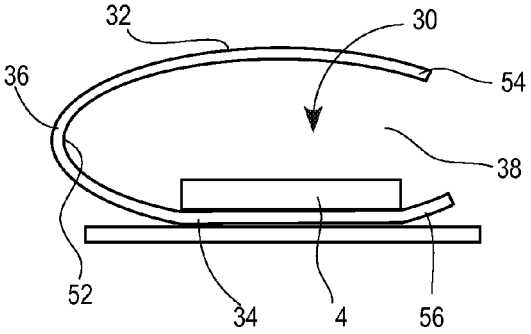
FIG. 5 is a cross-sectional elevation view of the partial enclosure of FIG. 3 with a food product advancing therein.
Figure 10:
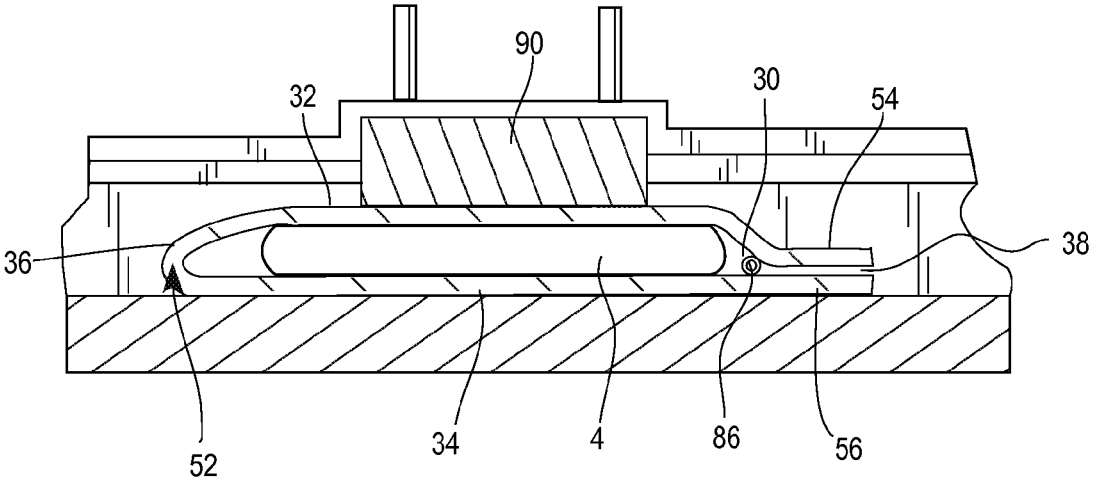
FIG. 10 is a cross-sectional elevation view of the modified atmosphere flow-wrap system of FIG. 8, taken along line 10-10.

More particularly, according to one approach, the flow-wrap station 8 includes rollers, belts or similar devices for feeding the film webbing 12 through the flow-wrap station 8. The longitudinal film webbing 12 is provided to the forming station 22 at a film infeed 44 area. The film infeed 44 includes a gap 26 formed between the saturation tunnel outlet 20 and a forming member inlet 46 through which the film 12 can enter the flow-wrap system 2. The gap 26 is preferably sized sufficiently small to reduce the influx of oxygen through the gap 26. In this regard, the forming member 28 is preferably at least partially enclosed to restrict oxygen from entering the flow-wrap system 2 through the forming member 28. The forming member 28 includes generally parallel upper and lower planar portions, vertically offset from one another and extending as upper and lower abutment surfaces 48 and 50 across the conveyor system. At the film infeed 44, film webbing 12 is drawn vertically downward through the gap 26 prior to being drawn through the forming member 28. During setup of the flow-wrap system 1, the film webbing 12 is folded over its longitudinal axis 52 such that its lateral edges 54 and 56 are positioned adjacent to one another with a first lateral edge 54 of the top panel 32 above a second lateral edge 56 of the bottom panel 34 forming an elongate partial enclosure 30 having the fold 36. As illustrated in FIGS. 5 and 10, once formed, the partial enclosure 44 comprises a generally C-shaped cross section including the top panel 32, the bottom panel 34, and the lateral side portion 36 at the location of folding of the film webbing 12 about its longitudinal axis 52. The partial opening 38 may be formed opposite the side portion 36 defined by a gap formed between the lateral edges 54 and 56 of the film webbing 12.

The film webbing 12 is fed through the forming member inlet 46 in this configuration, such that if the partial enclosure 30 begins to unfold the top panel 32, will contact the upper abutment surface 48 of the forming member 28 and the bottom panel 34 will contact the lower abutment surface 50 of the forming member 28, urging the lateral edges 54 and 56 toward one another and maintaining the webbing 12 in the partial enclosure 30 configuration. As the film webbing 12 is continuously drawn through the forming member 28, the upper and lower abutment surfaces 48 and 50 urge the top and bottom lateral edges 54 and 56 toward one another, continuously forming the film webbing 12 into the partial enclosure 30 configuration as it advances through the forming member 28. Food products 4 are generally continuously fed from the saturation tunnel outlet 20 and deposited onto an inner surface of the bottom panel 34 of the partial enclosure 30, at generally predetermined, intermittent positions, as the partial enclosure 30 is formed and drawn through the forming member 28.

A gas emitter 58 may be located adjacent the gap 26 to emit modified gas into the gap 26 and/or against what will be the inner, food facing surfaces of the film webbing 12 to restrict ambient air from being drawn into the film infeed 52 along with the film webbing 12. In one approach, the gas emitter 58 is in the form of an elongate pipe extending along the gap 26. The gas emitter 58 includes at least one opening or nozzle along at least a portion of the length of the pipe and may be situated adjacent to the film webbing 12 as it passes thereover, and specifically, in this example, the opening is adjacent to the side of the film webbing 12 that will form the interior of the partial enclosure 30 upon its formation. Modified gas flows through the pipe and is emitted from the opening, to saturate the film webbing 12 with modified gas, to displace residual oxygen from the film webbing 12 that may otherwise be drawn into the flow-wrap station 8, and to restrict oxygen from being drawn into the partial enclosure 30 or forming station 22 along with the film webbing 12 where it could otherwise enter the partial enclosure 30 or the food products 4 passing therethrough. Surprisingly, it has been found that if the flow rate of modified gas from the gas emitter 58 is too high, the overall oxygen concentration in the final package 10 may increase. Without being limited by theory, it is believed that high modified gas flow rates from the gas emitter 58 may restrict oxygen from the food products 4 or film webbing 12 from exiting through the gap 26. In this regard, the flow rate of gas from the emitter 58 should be sufficiently high to restrict oxygen from entering the flow-wrap station, but sufficiently low to avoid restricting oxygen from exiting through the gap. In one example, flow rates of between about 150 to about 300 standard cubic feet per hour ("scfh") for the modified gas exiting the gas emitter 58 are sufficient.

Similarly, it has been discovered that attempts to completely close off the partial enclosure 30 to the ambient air after the food products 4 are deposited within the partial enclosure 30 resulted in a larger quantity of residual oxygen remaining in the food products 4 after packaging is completed. Without being limited by theory, it is believed that during saturation of the food products 4 with modified gas in the saturation tunnel 6, small amounts of residual oxygen remain in the food products 4, and that by isolating the food products 4 from ambient air upon exiting the saturation tunnel 6, the residual oxygen is restricted from escaping from the food products 4. To address this, at least one vent 60 can be provided at the forming station 22 in order to provide a path for residual oxygen to escape from the food product 4 into the ambient air after the food product 4 as the food product exits the saturation tunnel 6 and is deposited in the partial enclosure 30. To this end, the at least one vent 60 can be positioned near the partial opening 38 of the partial enclosure 30, to provide a path for the residual oxygen to escape. In this example, the vent 60 is located at a lateral edge of the forming station 22 adjacent to the partial opening 38.

In one approach, the partial enclosure 30 is formed and the food product 4 is advanced along the conveyor system 16 from the saturation tunnel 6 and deposited therein. In another approach the food product is advanced on the conveyor system 16 and the partial enclosure 30 is formed about the advancing food product 4. Regardless of the approach used, after this step, the food product 4 is located within the partial enclosure 30 with a food product 4 bottom surface engaging the inner surface of the bottom panel 34 of the partial enclosure 30 such that the food product 4 rests thereon. The partial enclosure 30 continually advances, and accordingly, frictional forces acting between the bottom panel 34 and the food product 4 cause the food product 4 to be advanced therewith.

Figure 9:
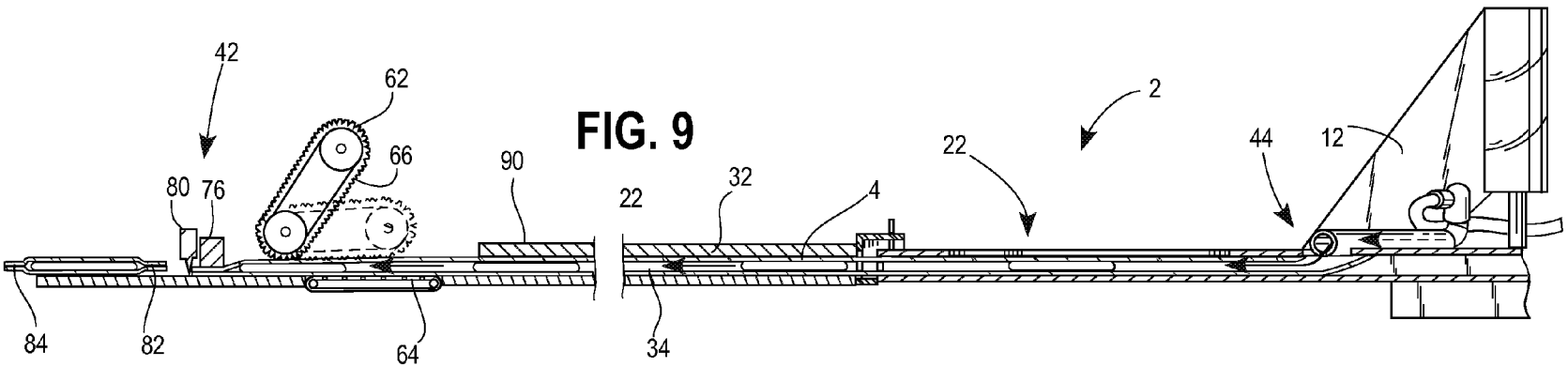
FIG. 9 is a partial cross-sectional elevation view of the modified atmosphere flow-wrap system of FIG. 8, taken along line 9-9.

In one example, advancing the film webbing 12 is accomplished by drawing the film webbing 12 between a pair of closely spaced downstream belts or rollers. In one example, a top belt 62 is disposed above a bottom belt 64 with a lower run 66 of the top belt 62 positioned closely adjacent to or in contact with an upper run 68 of the bottom belt 64. The film webbing 12 can be fed between the top and bottom belts 62 and 64 in the partial enclosure 30 orientation. So configured, the belts 62 and 64 draw the partial enclosure 30, including the food products 4, downstream and between the belts 62 and 64. To this end, the top belt 62 may be made of resilient material so that it will resiliently deform to allow the food products 4 to pass thereunder. As illustrated in FIGS. 8 and 9, the top belt 62 may be rotated away from the bottom belt 64 to provide access to the bottom belt 64.

Figure 11:
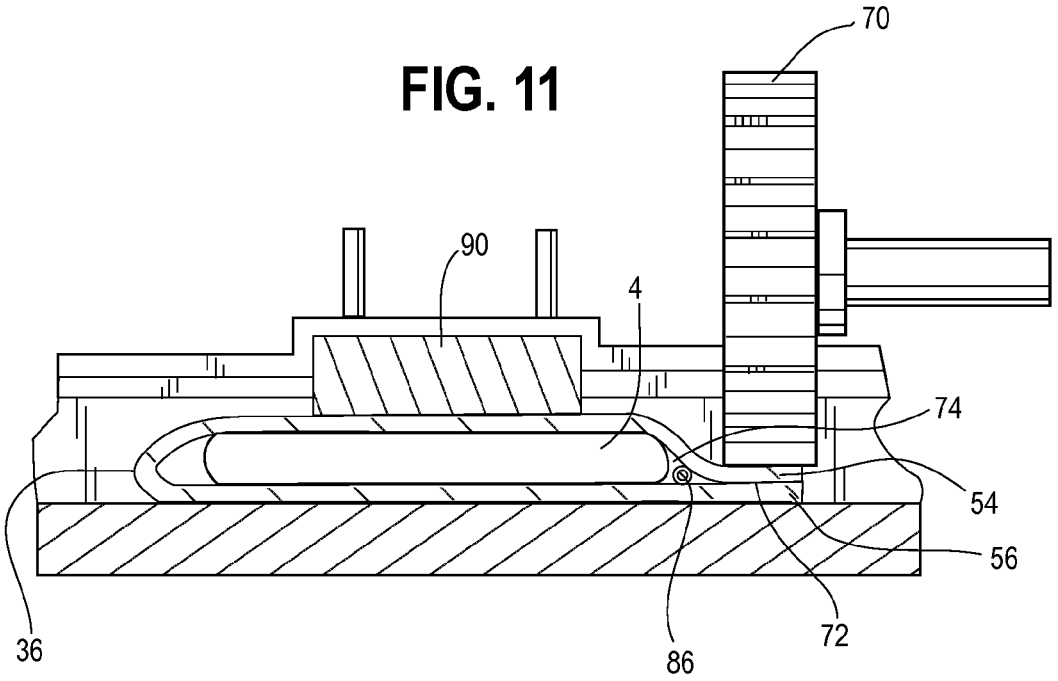
FIG. 11 is a cross-sectional elevation view of the modified atmosphere flow-wrap system of FIG. 8 taken along line 11-11.

The partial enclosure 30 containing the food products 4 is next advanced to a longitudinal sealing station 40. In this example, the longitudinal sealing station 40 includes one or more fin seal rollers 70 positioned along the advancing lateral edges 54 and 56 of the partial enclosure 30. The advancing lateral edges 54 and 56 of the partial enclosure 30 are fed into and between the fin seal rollers 70 to form a longitudinal seal 72 between the lateral edges 54 and 56, thereby closing the partial opening 38 of the partial enclosure 30 to form an open ended tubular precursor 74, as illustrated in FIG. 11, with the food products 4 advancing therein. The rotating fin seal rollers 70 may also act to draw the film webbing 12 downstream, although because the fin seal rollers 70 are only positioned on one lateral edge of the webbing 12 in this approach, they may tend to mistrack the film webbing. In one approach, the bottom belt 64 may include a vacuum belt for drawing the film webbing downward against the belt 64 and maintaining the film webbing 12 in its desired advancing orientation to restrict lateral mistracking of the film webbing 12.

Figure 3:
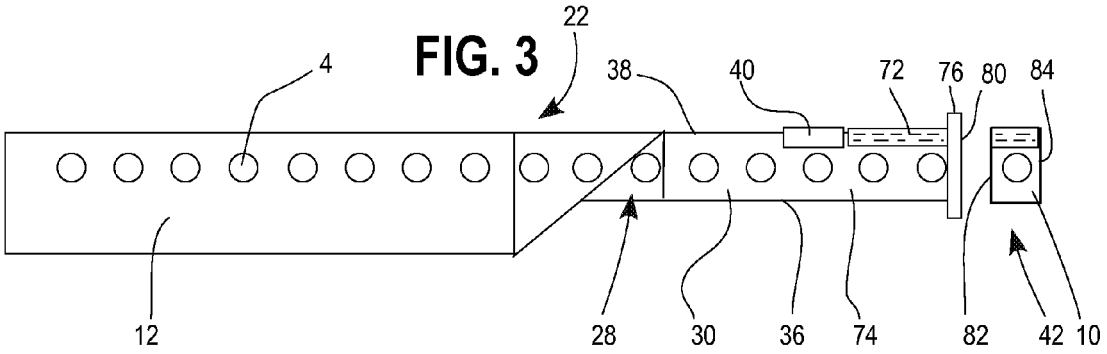
FIG. 3 is a top plan diagrammatic view of a flow-wrap station of the modified atmosphere flow-wrap system of FIG. 1, showing a film webbing being formed into a partial enclosure about advancing food products and showing a longitudinal sealer and a cross sealer/cutter used to seal and separate food packages.

The tubular precursor 74, along with the food products 4, is next advanced to a lateral cross-sealing station 42. In this example, the cross-sealing station 42 is in the form of a long dwell cross-sealer 76 that provides lateral seals 78 between the top and bottom panels 32 and 34 of the tubular precursor 74 at predetermined intervals between the intermittently spaced food products 4 generally continuously advancing within the tubular precursor 74. A cutter 80 provides lateral cuts along each lateral seal 78 to separate the lateral seal into a rear seal 82 for the leading food product and a front seal 84 for the trailing food product, although in another approach, two lateral seals are made between food products, and the cutter 80 cuts between the two seals to form the seals for the leading and trailing packages. After cutting the lateral seal 78, an individual hermetically sealed food package 10 is formed downstream of the cut, which is completely formed and sealed about the leading food product 4 and separated from the tubular precursor 74 and film webbing 12, as represented in FIGS. 2 and 3. Continuously repeating the above process results in the formation of a plurality of individual food packages 10.

It should be noted, that because the lateral cross-sealer may continuously provide new lateral seals 10 across the tubular precursor 74 prior to separation of a food package 10, a downstream end of the tubular precursor 74 is always sealed or at least typically sealed. However, the tubular precursor 74 is in communication with ambient air via the partial opening 38 of the partial enclosure 30. Thus, in order to reduce an amount of oxygen reentering the food product 4 and the tubular precursor 74 due its communication with the ambient air, and to further dispel and dilute residual oxygen remaining in the food product 4 in order to attain a desired final level of oxygen within the sealed food package 10, one or more conditioning lances 14 extend through the partial opening 38 of the partial enclosure 30 and into the tubular precursor 74.

In one approach, the conditioning lance 14 is a modified gas lance 86 for dispensing a modified atmosphere gas into the tubular precursor 74. In this approach, a portion of the gas lance 86 extends through the partial enclosure 30 along the partial opening 38 and into the tubular precursor 74. The gas lance 86 may be in the form of a elongated rigid tube that extends in a cantilevered orientation into the tubular precursor 70, and includes one or more openings or nozzles 88 for dispensing the modified atmosphere gas into the partial enclosure 30 and/or the tubular precursor 74 and toward the advancing food products 4 to further saturate the food products 4 with the modified atmosphere gas and provide a modified atmosphere within the tubular precursor 74 and restrict oxygen from entering the partial enclosure 30 or tubular precursor 74 from the ambient air.

In one example, the one or more openings 88 may be on the portion of the gas lance 86 extending into the tubular precursor 74, and the end of the gas lance may include an opening at its longitudinal end for emitting modified gas from the end of the lance 86. The gas lance 86 may be positioned to extend along the partial opening 38 to additionally provide a barrier to restrict ambient air from entering, and modified gas from exiting, the tubular precursor 74 and partial enclosure 30, while not restricting oxygen from being dispersed from the tubular precursor 74 and the partial enclosure 30. Positioning the gas lance 86 along the partial opening 38 also allows a shorter gas lance to be utilized, since the gas lance does not need to extend through the partial opening 38 across the partial enclosure and along the folded lateral side portion 38. In this regard, the gas lance 86 does not have to be as thick to support the additional length in cantilever, reducing the cross sectional dimension of the gas lance 86 and interference with the food products 10.

An amount of modified gas that is dispensed from the one or more openings 88 should be sufficient, based, for example, on empirical data, to reduce a final concentration of oxygen within the sealed food package 10 to a desired concentration. In one approach, the longitudinal end of the gas lance 86 includes an opening and modified gas is emitted from the opening at a sufficiently high pressure to produce wind or flow of the modified gas upstream in a direction opposite to the direction in which the food products 4 are advancing. In this regard, the high pressure modified gas may further force oxygen away from the food products so that it exits the partial opening 38 or the vent 60. In one example, the desired concentration of oxygen in the food package 50 is below 3%. In another example, the desired concentration of oxygen in the food package 10 is below about 2%. In another example, the desired concentration of oxygen in the food package 10 is below 1%. In still another example, the desired concentration of oxygen in the food package 10 is below 0.5%. It has been discovered that to decrease the amount of oxygen within the final food package 10 to a larger extent, it is beneficial to extend the gas lance 86 into close proximity to the cross-sealer 22, and more specifically to provide an opening thereof for emitting modified gas in close proximity to the cross-sealer 76. In one example, modified gas is emitted from an end opening in a modified gas lance 86 at a flow rate of between about 150 and 300 scfh.

It has been found that dispensing modified gas into the tubular precursor 74 from the gas lance 86, as described can inflate the tubular precursor, thus causing a "floating" effect of the food product 4 within the tubular precursor 74.

Specifically, the food products 4 advancing upon the inner surface of a bottom panel 34 of the tubular precursor 74 tend to exhibit a "floating" effect in which the frictional forces between the food product 4 and the inner surface are reduced and the food product 4 tends to move along the inner surface, allowing the food product 4 to shift out of its predetermined intermittent location within the tubular precursor 74. This shifting of the food product 4 can be undesirable because the cross-sealer 76 and cutter 80 may be configured to provide cross seals and cuts across the tubular precursor 74 at predetermined locations where it is determined that the food products 4 should not be located based on their predetermined intermittent spacing. Thus, if the food product 4 shifts into the predetermined locations of sealing and cutting, the cross-sealer 76 may seal across the food product 4 and the cutter 80 may cut across the food product 4, ruining the food product, and potentially damaging the equipment. Alternatively, additional equipment must be used to return the food products 4 to their predetermined, intermittent locations, adding completely to and slowing the process.

To address the problem of "floating" food products 4, a pressure element 90 is provided above the partial enclosure 30 and the tubular precursor 74 to provide downward pressure thereon. Specifically, the pressure element 90 applies downward pressure, such as by the weight of the pressure element 90, to the food products 1 to ensure that sufficient friction is maintained between the food product 4 and the inner surfaces of the tubular precursor 74 and partial enclosure 30 upon which the food products advance, so that the food product 4 is restricted from "floating" and shifting thereon, such that its predetermined location is maintained. The pressure element 90 can include any type of mechanism or structure capable of applying a downward pressure on the upper portions of the partial enclosure 30 and/or the tubular precursor 74 and the food products 4, while allowing the food products 4 and the film webbing 12 to continually progress downstream. The pressure element 90 can include, but is not limited to, a rigid upper surface, rollers, and a conveyor belt. In one approach, the pressure element 90 is an elongate weighted bar positioned above the food products and configured to be movable only in a vertical direction, upward away from the food products 1 or downward toward the food products 1 to allow the food products 1 to advance thereunder. To this end, the weighted bar may include vertically oriented boreholes that slidingly mate with vertical shafts which allow the weighted bar to move vertically but restrict movement in other directions.

In addition, because according to this approach, modified gas is emitted at a high pressure from a longitudinal end opening of the gas lance 86, the tubular precursor 74 may become inflated to a large volume. However, it is typically desirable that product packages 10 have low volumes and a minimized amount of headspace. To address this, as mentioned previously, the top belt 62 may be resilient or include at least one resilient portion with its lower run 66 closely adjacent to or in contact with the upper run 68 of the bottom belt 64. The belts 62 and 64 may be positioned close to the end opening of the gas lance 86 to draw the tubular precursor 74 therebetween. In this regard, the top belt 62 acts as a deflator belt that urges the tubular precursor 74 toward the bottom belt 64 which serves as an anvil so that the tubular precursor 74 is squeezed between the bottom belt 64 and the upper belt 62 or resilient portion thereof, to deflate the tubular precursor 74, by forcing gas upstream, and reducing the headspace therein.

Figure 6:
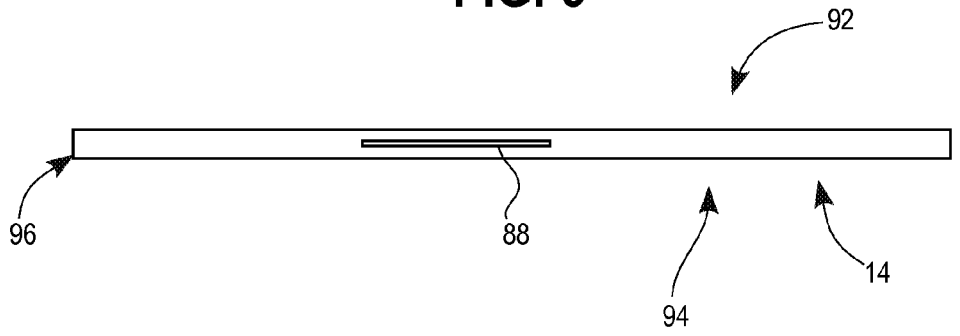
FIG. 6 is a side elevation of a conditioning lance in the form of a gas and vacuum lance.

In another approach, the conditioning lance 14 is a combined modified atmosphere gas and vacuum lance 92 as illustrated in FIG. 6. In this approach, the gas and vacuum lance 92 extends generally longitudinally through the partial opening 38 of the partial enclosure 30 and into the tubular precursor 74. An upstream portion 94 of the gas and vacuum lance 92 includes one or more openings or nozzles 88 for dispensing a modified atmosphere gas, as described above, for saturating the partial enclosure 30, the tubular precursor 74, and the advancing food product 4 with a modified atmosphere gas, and dispelling ambient air from the partial enclosure 30 and tubular precursor 74.

Figure 4:
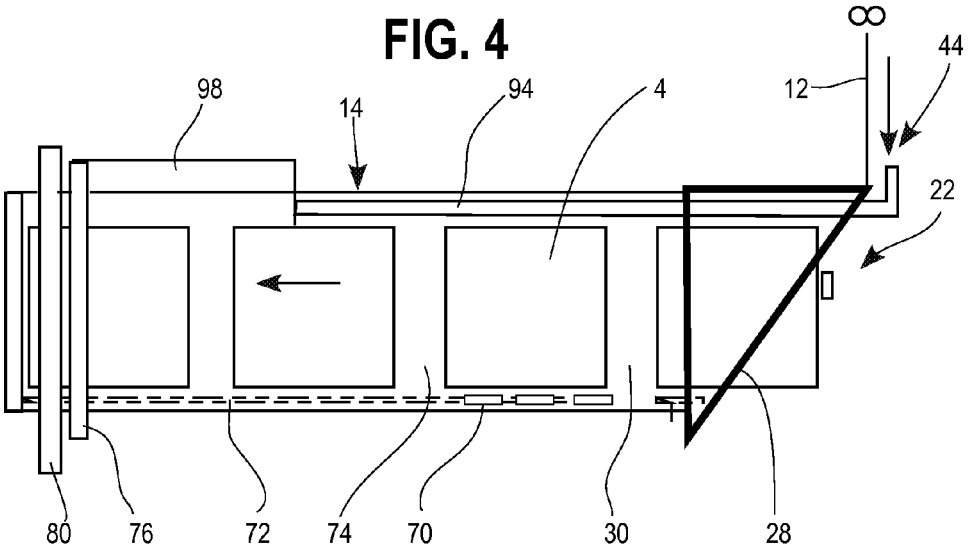
FIG. 4 is a top plan diagrammatic view of the flow-wrap station of FIG. 3, showing a conditioning lance extending into the partial enclosure and side cross sealing stations configured for sealing the partial enclosure for forming a three side sealed food package.

In this example, a downstream portion of the gas and vacuum lance 92 of this example includes a vacuum portion 96, positioned within the tubular precursor 74 for extracting gas therefrom. The vacuum portion 96 provides the additional benefit of drawing the top panel 32 of the partial enclosure 30 toward the bottom panel 34 of the partial enclosure 30 to capture the food product 4 therebetween, thereby reducing the headspace of the sealed food package 10. However, the vacuum portion 96 has been discovered to tend to also pull the bottom panel 34 upward and shift the bottom panel 34 and food products 4. To address this, at least a portion of the conveyor system 16 may be disposed within the flow-wrap station and can include a bottom vacuum (FIGS. 4, 8, and 9). In this example, the bottom belt 64 for drawing the film webbing 12 through the forming station 22 can include a vacuum belt, as described previously, that provides a downward suction force on the bottom panel 34 of the partial enclosure 30 to oppose an upward force acting on the bottom panel 34 by the vacuum portion 96 of the gas and vacuum lance 92. Thus, the bottom vacuum belt 64 can maintain the bottom panel 34 of the partial enclosure 30 in a relatively horizontal plane and in engagement with the conveyor system 16 or bottom vacuum belt 64 as it advances thereover.

The cross-sealing station 42 may be positioned downstream of the top belt 62 to laterally seal and singulate a food package 10. As mentioned, it has been discovered that to minimize the concentration of oxygen in the final food package 10, it is advantageous to extend the conditioning lance 14 as closely as possible to the cross sealer 76. In this regard, in one approach, the conditioning lance 14 extends between the bottom vacuum belt 64 and the top belt 62, with its end in close proximity to the cross sealer 76. In this approach, at least one opening of the conditioning lance 14 is located in close proximity to the cross sealer 76 and configured to dispense modified atmosphere gas at a high pressure near this location. More specifically, in one approach, the end opening of a gas lance, as described previously includes an opening at its longitudinal end, and extends between the bottom vacuum belt 64 and the top belt 62.

While the foregoing is described in terms of the gas lance 86 or the gas and vacuum lance 92 illustrated in FIG. 6, it should be readily understood that a variety of configurations of gas and/or vacuum lances may be utilized that may be positioned at various locations within the partial enclosure 30 or tubular precursor 74 as the food products 4 are advanced therein. For example, separate gas and vacuum lances may be utilized. In one example, separate gas and vacuum lances extend along opposite lateral sides of advancing food products 4 into the partial enclosure 30 and tubular precursor 74. In one approach, the conditioning lances 14 may be sized and positioned to reduce interference with the food product 4. To this end, the conditioning lances 14 may be positioned laterally adjacent to the conveyed food products 4, as illustrated in FIGS. 2 and 8 to reduce contact between the conditioning lances 14 and the food products 4.

The conditioning lances 14, according to one approach, include elongate, rigid hollow tubes, that are of sufficiently cross-sectional dimensions to minimize interference between the conditioning lances 14 and the advancing film webbing 12 and food products 4. In one example, the cross-sectional dimension of the conditioning lance 14 is less than about 0.25 inches.

Figure 7:
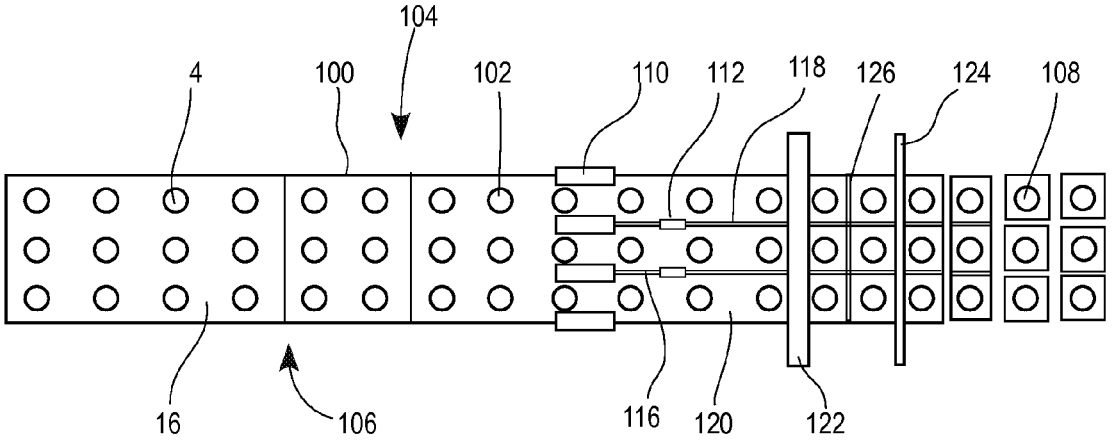
FIG. 7 is a top plan diagrammatic view of a flow-wrap station that can be used with the modified atmosphere flow-wrap system of FIG. 1 according to another approach, showing top and bottom film webs being formed into four side sealed food packages around food products.
Figure 12:
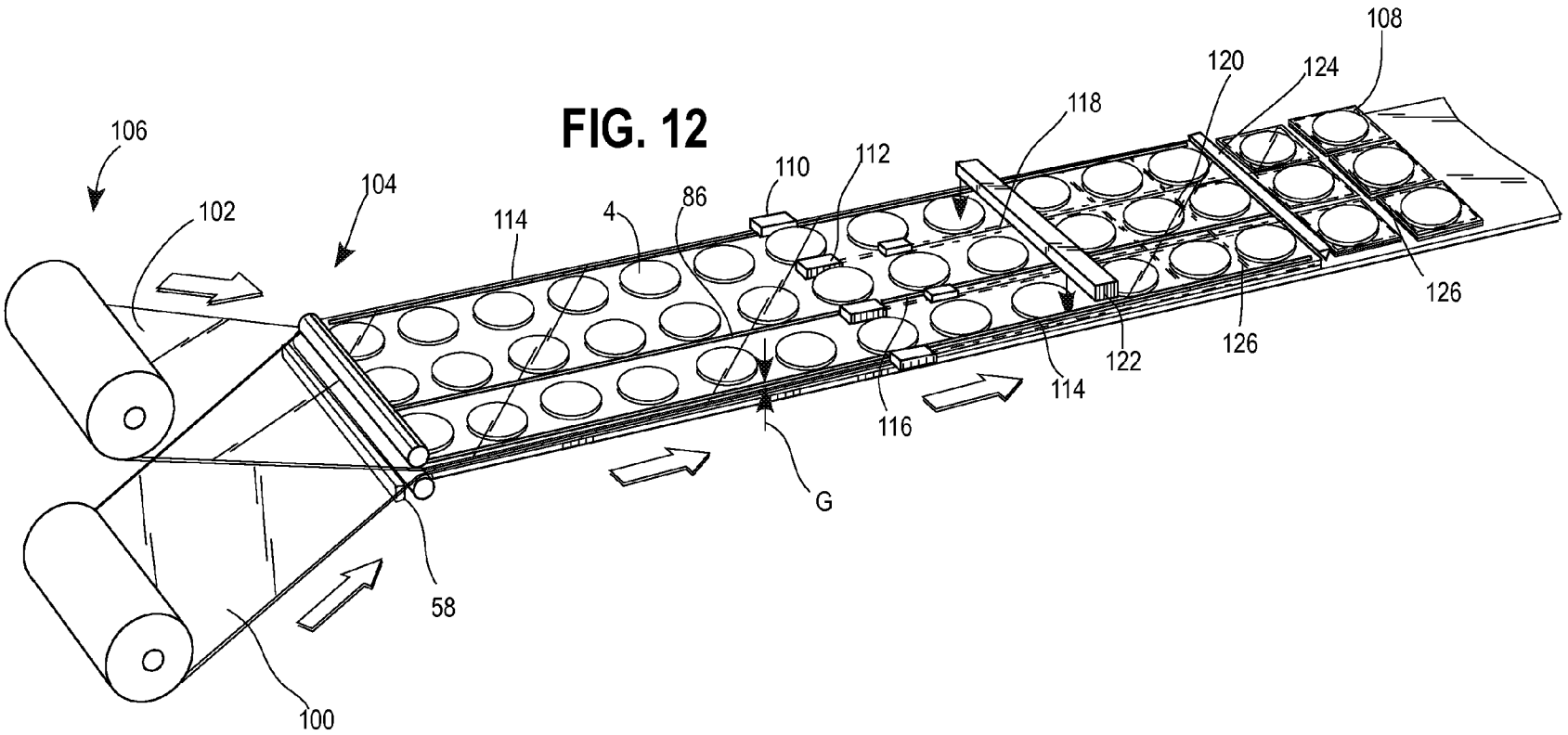
FIG. 12 is a perspective view of a flow-wrap station of a modified atmosphere flow-wrap system according to another approach, showing top and bottom film webs being formed into four side sealed food packages around food products.

Another approach illustrated in FIGS. 7 and 12 utilizes a similar mechanism as the previous approach except that two film webs 100 and 102 are fed into a flow-wrapping station 104 and are configured to advance longitudinally therethrough. In this approach, the food products 4 are first advanced through a conditioning tunnel, in the form of a saturation tunnel, as described previously to reduce the concentration of residual oxygen in the food products 4. After the products exit the saturation tunnel, they enter a flow-wrapping station 104. In this approach, as in the previous approach, the flow-wrapping station 104 may include rollers, belts, or similar devices for feeding the two film webs 100 and 102 through the flow wrapping station 104. More particularly, a bottom film web 100, with its plane in substantially horizontal alignment, is advanced through the flow-wrapping station 104. A top film web 102 aligned in parallel relation to and offset above the bottom film web 100 is similarly advanced so that a gap G is defined between the parallel top and bottom film webs 100 and 102. In this approach, a single row of food products 4 may be advanced, along the conveyor 86, or multiple rows of food products 4 may be advanced, as illustrated in FIGS. 7 and 12, spaced laterally across the conveyor 16 at predetermined locations. In one approach, the food products 4 are advanced through a saturation tunnel 6 as described previously, prior to flow-wrapping the food products 4.

The top and bottom film webs 102 and 100 are fed into the flow-wrapping station 104 at film in-feeds 106 and a gas emitter 58, as described previously, may be configured to dispense modified atmospheric gas at the film in-feeds 106 to saturate the inner surfaces of the film webs 100 and 102 with modified gas and reduce the concentration of oxygen within the final food package 108.

In one approach, multiple rows of food products 4 are advanced to and deposited on the bottom film web 100, at predetermined, intermittent lateral and longitudinal positions, either prior to or after the introduction of the top film web 102 to become situated in the gap G with a food product 4 lower surface resting on the upper surface of the bottom film web 100. The food products 4 are advanced on and along with the advancing bottom film web 100 due to friction acting between the food products 4 and the bottom film web 100.

In this example, a plurality of longitudinal sealers 110 and longitudinal cutters 112 are laterally positioned across the width of the flow-wrap station 104 between the predetermined lateral positions of the advancing foods products 4, and also adjacent to the lateral edges 114 of the top and bottom film webs 100 and 102. As the food products 4 are advanced, the longitudinal sealers 110 continuously seal portions of the top and bottom film webs 100 and 102 together, between and adjacent to the food products 4 and along the lateral edges 114 of the top and bottom film webs 100 and 102 to form generally parallel longitudinally extending seals 116 between and along the edges of the food products 4. The longitudinal cutters 112 provide longitudinal cuts 118 along the sealed lines 116 as the food products 4 advance to separate portions of the film webbing, thereby forming a plurality of generally longitudinally parallel tubular precursors 120.

Because, prior to sealing, ambient air can enter the gap G via both lateral openings and at the film in-feeds 106. In one approach, conditioning lances 14 as described above, extend into the tubular precursors 120 to dispel ambient air, provide a modified gas, and reduce the concentration of oxygen within the tubular precursors 120 to a desired level prior to forming packaged food products 108. In this regard, because a plurality of tubular precursors 120 are formed, in this approach, multiple conditioning lances 14 extend downstream into the tubular precursors 120 as described previously, to minimized interference between the conditioning lances 14 and the film webs 100 and 102 and food products 4. In one approach, the conditioning lances 14 are in the form of modified atmosphere gas lances 86, as described previously. If the conditioning lances 14 include vacuum portions 96, the top film web 102 is drawn downward toward the bottom film web 100 by the vacuum portion 96 to reduce the head space in the final food packages 108. In this example, the conveyor system 16 may include top and bottom downstream belts 62 and 64, as described, previously, and the bottom belt may include a vacuum belt or other lower vacuum providing a downward suction force for drawing the bottom film web 100 downward to oppose an upward force generated by the vacuum portion 96 of the conditioning lance 14, as described previously, to maintain the bottom film web 100 in relatively horizontal alignment and in engagement with the vacuum belt 64. The top belt 62 may serve as a deflator belt for deflating gas from within the tubular precursors. In addition, pressure elements 90 may be provided to maintain the food products 4 in a desired orientation as they advance through the flow-wrapping station 104.

In one approach, the tubular precursors 120 are advanced to a lateral sealer 122 and a lateral cutter 124. In this example, the lateral sealer 122 is a long dwell cross sealer that continuously provides generally lateral seals between the top and bottom film webs 100 and 102 of the tubular precursors 120 at predetermined intervals, between advancing food products 4 therein. As described above, a lateral cutter 124 provides lateral cuts along the lateral seals 126 to create a rear seal for the leading food product 4 and a front seal for the trailing food product 4, although separate seals may be formed with the cutter providing cuts between the separate seals. Upon cutting of a lateral seals, to form rear seals for the row of leading food products, singulated substantially hermetic four sided sealed food packages 108 are formed for each of the laterally spaced food products 4.

Figure 13:
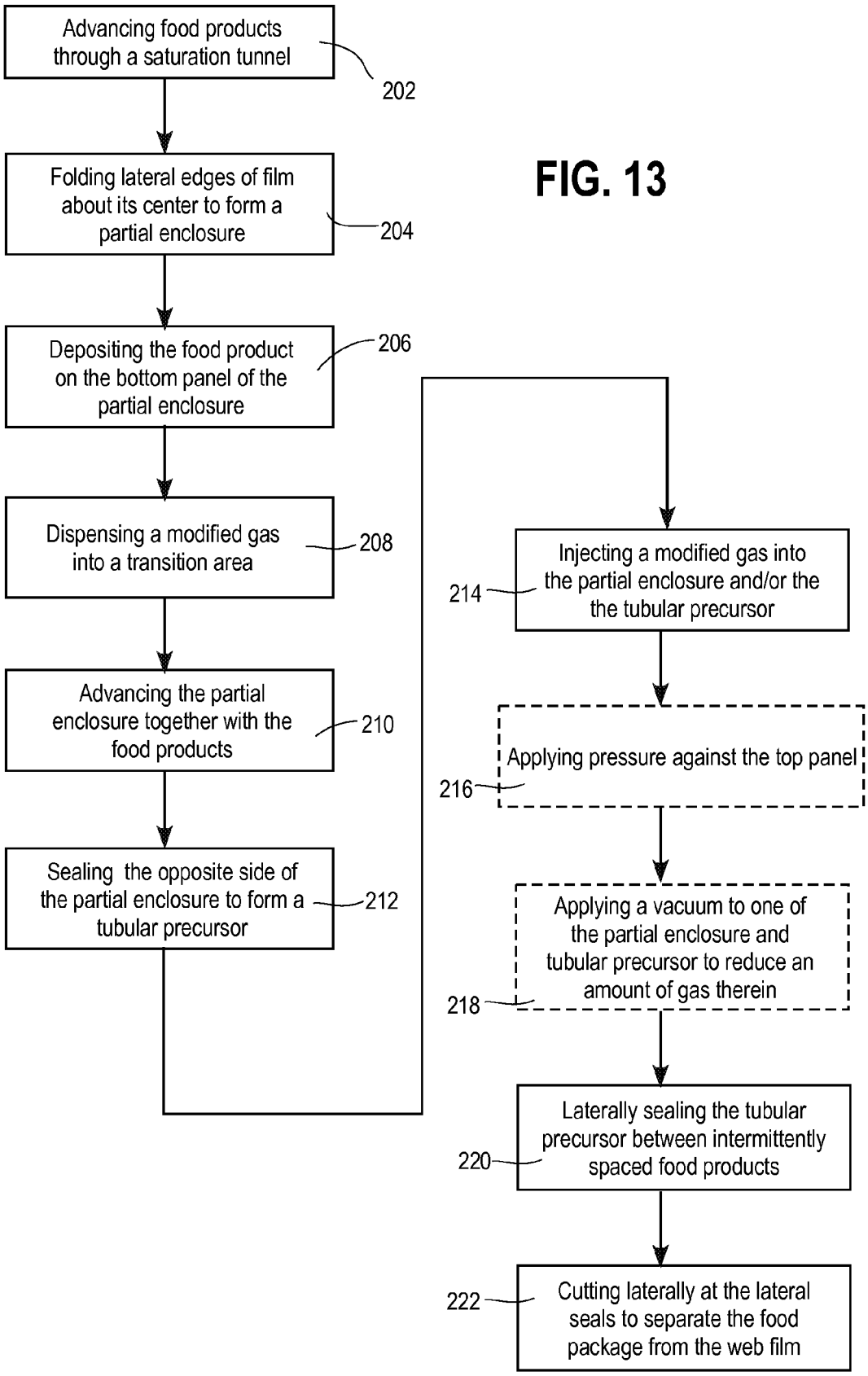
FIG. 13 is a flow diagram of an exemplary method for flow-wrapping food products in a reduced oxygen atmosphere.

An example method for packaging food products into reduced oxygen packages will now be described with reference to FIG. 13. The method includes at step 202, advancing the food products through a saturation tunnel to reduce the concentration of residual oxygen in the food product to a desired level. At step 204, the method includes folding lateral edges of a web of film about its center to form a partial enclosure with a top panel, a bottom panel, and an opening. According to step 206, the method includes depositing the food product on the bottom panel of the partial enclosure and advancing the food product and partial enclosure. At step 208, the method optionally includes dispersing a modified gas into a transition area between where the film is introduced and folded and the food product is deposited therein to restrict oxygen from the surrounding atmosphere from entering the food product as it moves through the transition area.

At step 210, the method includes advancing the partial enclosure together with the food products located therein downstream. The method also includes, at step 212, sealing the opening of the partial enclosure to form a tubular precursor. At step 214, the method includes injecting a modified gas into the partial enclosure and/or tubular precursor for saturating the food product with modified gas and restricting oxygen from the surrounding atmosphere from entering the food product. The method optionally includes, at step 216, providing pressure against the tope panel to restrict movement of the food product relative to the partial enclosure, which may otherwise occur in response to pressurized modified gas being injected into the partial enclosure. At optional step 218, the method includes applying a vacuum to the partial enclosure and/or tubular precursor to reduce the amount of gas therein and reduce the headspace of a final package. At step 220, the method includes laterally cross-sealing the tubular precursor at a front and rear location relative to an advancing food product to form a substantially hermetically sealed food package. Finally, at step 222, the method includes singulating the sealed food package by laterally cutting across the seal between the sealed food package and the web of film to separate the food package from the web of film.

From the foregoing, it will be appreciated that methods and apparatus for use in forming modified-atmosphere food packages are described. However, the disclosure is not limited to the aspects and embodiments described hereinabove, or to any particular embodiments.

The invention claimed is:

1. A method of forming a reduced oxygen food package, the method comprising:

conditioning the food product to reduce an amount of residual oxygen within the food product;

forming a partial enclosure, having a laterally outward opening, from a web of film around the food product as the food product is conveyed in a machine direction using a folding member having laterally outward side portions extending generally parallel to the machine direction, wherein the folding member includes one or more vents along one of the side portions thereof aligned with the opening of the partial enclosure to provide a path for residual oxygen to escape from the partial enclosure prior to sealing the web of film;

sealing one side of the partial enclosure to form a tubular precursor around the food product;

subjecting the food product in one of the partial enclosure and the tubular precursor to a modified atmosphere gas while advancing the food product; and sealing the tubular precursor to create a substantially hermetic food package surrounding the food product.

2. A method of forming a reduced oxygen food package in accordance with claim 1, further comprising applying a vacuum to one of the partial enclosure and the tubular precursor to reduce an amount of gas therein after the step of subjecting the food product to a modified atmosphere gas and while advancing the food product.

3. A method of forming a reduced oxygen food package in accordance with claim 1, wherein the conditioning step comprises advancing the food package through a saturation tunnel introducing modified atmosphere gas for displacing and diluting residual oxygen within the food product.

4. A method of forming a reduced oxygen food package in accordance with claim 1, wherein the step of forming the partial enclosure comprises:

advancing a length of the web of film; and folding lateral edges of the web of film about a center portion of the web of film toward each other to define a partially enclosed space therein.

5. A method of forming a reduced oxygen food package in accordance with claim 4, further comprising applying pressure to the food product while advancing the food product within one of the partial enclosure and the tubular precursor to restrict movement of the food product relative to the web of film.

6. A method of forming a reduced oxygen food package in accordance with claim 4, further comprising curving the web of film to form a generally C-shaped cross section of the web of film such that the partial enclosure has an open side between the curved lateral edges of the web of film and a closed side at the location of folding of the web of film.

7. A method of forming a reduced oxygen food package in accordance with claim 4, wherein the partial enclosure is sealed by:

sealing the lateral edges of the web of film together while advancing the partial enclosure; and sealing together longitudinally leading and trailing edges of the film webbing with regard to the food product located therein.

8. A method of forming a reduced oxygen food package in accordance with claim 1, wherein the subjecting the food product and the partial enclosure to the modified atmosphere gas comprises injecting a modified atmosphere gas into one of the partial enclosure and the tubular precursor.

9. A method of forming a reduced oxygen food package in accordance with claim 8, wherein a gas lance with at least a portion thereof extending into one of the partial enclosure and the tubular precursor is used to inject the modified atmosphere gas.

10. A method of forming a reduced oxygen food package in accordance with claim 2, wherein a vacuum lance, with at least a portion thereof extending into one of the partial enclosure and the tubular precursor, is used to apply the vacuum.

11. A method of forming a reduced oxygen food package in accordance with claim 2, wherein the steps of applying a vacuum to the partial enclosure and subjecting the food product and the partial enclosure to a modified atmosphere gas are performed simultaneously at different longitudinal locations within the partial enclosure.

12. A method of packaging a series of oxygen-containing food products comprising:

advancing said oxygen-containing food products on a conveyor in a machine direction through a tunnel having an entrance and an exit end on a continuing basis such that each of said food products is within said tunnel for a period of time;

introducing a first gas that is essentially free from oxygen into said tunnel so as to displace air from said tunnel and maintain oxygen in said tunnel at a minimal level on a continuing basis, thereby reducing the oxygen content of said food products to residual levels, and providing egress of said gas from at least said exit end;

partially enclosing said food products in film wrap on a continuing basis using a folding station having side portions extending generally parallel to the machine direction, wherein the folding member includes one or more vents along one of the side portions thereof to provide a path for residual oxygen to escape from the food products prior to sealing the film wrap as the food products emerge from the exit of said tunnel so as to form a tubular precursor comprising an open-ended tube having an opening proximal to the exit end of said tunnel;

introducing a second gas that is essentially free from oxygen into a region adjacent said film wrap upstream of said open-ended tubular precursor;

introducing a third gas that is essentially free from oxygen into said open-ended tubular precursor;

partially enclosing a region between said exit end and said precursor; providing a vent path for egress of residual oxygen and other gases from said partially enclosed region; and transversely sealing and dividing said precursor at predetermined intervals on a continuing basis to form a series of discrete hermetically sealed packaged food products having a reduced oxygen content.

13. A method of packaging a series of oxygen-containing food products in accordance with claim 12, wherein the period of time is at least about 12 seconds.

14. A method of packaging a series of oxygen-containing food products in accordance with claim 12, wherein the period of time is between about 12 seconds and 15 seconds.

15. A method of packaging a series of oxygen-containing food products in accordance with claim 12, wherein the reduced oxygen content is below about 3%.

16. A method of packaging a series of oxygen-containing food products in accordance with claim 15, wherein the reduced oxygen content is below about 2%.

17. A method of packaging a series of oxygen-containing food products in accordance with claim 12, wherein the reduced oxygen content is below about 1%.

18. A method of packaging a series of oxygen-containing food products in accordance with claim 12, wherein the reduced oxygen content is below about 0.5%.

* * * * *